US006409173B1

(12) United States Patent
Tri

(10) Patent No.: US 6,409,173 B1
(45) Date of Patent: Jun. 25, 2002

(54) METHOD AND APPARATUS FOR PLAYING A MULTI COMPONENT WAGERING GAME

(75) Inventor: George Tri, Sandstone, MN (US)

(73) Assignee: Corporate Commission of Mille Lacs Band of Ojibwe Indians, Onamia, MN (US)

( * ) Notice: Subject to any disclaimer, the term of this patent is extended or adjusted under 35 U.S.C. 154(b) by 0 days.

(21) Appl. No.: 09/483,882

(22) Filed: Jan. 18, 2000

(51) Int. Cl.[7] ..... A63F 1/00; A63F 3/06
(52) U.S. Cl. ..... 273/292; 273/269
(58) Field of Search ..... 273/269, 292; 463/12, 13

(56) References Cited

U.S. PATENT DOCUMENTS 5,393,057 A * 2/1995 Marnell, II ..... 273/269
6,079,711 A * 6/2000 Wei et al. ..... 273/269

* cited by examiner

*Primary Examiner*—Benjamin H. Layno
(74) *Attorney, Agent, or Firm*—Schwegman, Lundberg, Woessner & Kluth, P.A.

(57) ABSTRACT

A method of playing a combined wagering game which includes the common features and excitement associated with typical card games, and, through use of a special gaming card, provides additional excitement and a different gaming experience for the players. The gaming card, utilized in the method of the present invention, resembles a classical Bingo card with several, notable revisions however. More specifically, the gaming card includes a listing of various hands typically received when playing the underlying base game. The base game may include Poker or Blackjack, both of which are well known table games. When playing the base game, and obtaining one of the hands listed on the gaming card, the player is then allowed to blacken the corresponding square. If a number of squares are blackened in a predetermined pattern, the player is then eligible to win some type of prize, be it monetary or material. The game of the invention can be played in either a table top version, or a video gaming version.

20 Claims, 3 Drawing Sheets

52

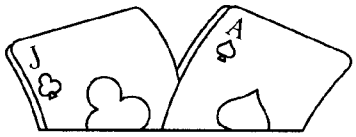

BLACKJACK

| B | I | N | G | O |
|---|---|---|---|---|
| 6-7-8 54 | FIVE CARD CHARLIE 56 | ACE-JACK OF HEARTS BLACKJACK 58 | ANY SPLIT HAND 68 | 7-7-7 70 |
| ANY SPLIT HAND 68 | SAME SUIT BLACKJACK 66 | SPLIT TO MAKE THREE HANDS 72 | SAME SUIT BLACKJACK 66 | FIVE CARD CHARLIE 56 |
| ACE-JACK OF SPADES BLACKJACK 62 | SPLIT TO MAKE THREE HANDS 72 | FREE | SPLIT TO MAKE THREE HANDS 72 | ACE-JACK OF DIAMONDS BLACKJACK 64 |
| FIVE CARD CHARLIE 56 | SAME SUIT BLACKJACK 66 | SPLIT TO MAKE THREE HANDS 72 | SAME SUIT BLACKJACK 66 | ANY SPLIT HAND 68 |
| 7-7-7 70 | ANY SPLIT HAND 68 | ACE-JACK OF CLUBS BLACKJACK 60 | FIVE CARD CHARLIE 56 | 6-7-8 54 |

FIG. 2

METHOD AND APPARATUS FOR PLAYING A MULTI COMPONENT WAGERING GAME

BACKGROUND OF THE INVENTION

The present invention relates to a method of playing a wagering game utilizing a standard deck of playing cards and a cooperating game card. More specifically, the method of the present invention is an enhancement to a base game (including Blackjack, Twenty-One, or Poker) which provides additional winning opportunities based upon a bingo-type card provided to the player.

Many different wagering games presently exist for use in both home and casino environments. Such games should necessarily be exciting, uncomplicated and easy to learn so as to avoid frustrating the players. Card games such as poker and Twenty-One have gained widespread popularity because of their established ranking of hands and well known rules. Furthermore, each of these games usually involve continuous wagering and winning opportunities for the players thus increasing player participation and excitement. Lastly, the games move fairly quickly to maintain action and activity. All of these factors have created games which are widely accepted and widely known.

When devising wagering games, it is desirable to find a game that is easy to play and also fast moving. When the player is provided with a considerable amount of participation,.and winning opportunities based on card combinations not necessarily related to the play of the base game, these games become much more enjoyable. Furthermore, a game is more exciting if a player feels anticipation and excitement from a number of different sources throughout the game.

In addition to the well known card games mentioned above, the game of Bingo is well known and often played as a wagering game. Bingo offers a separate and different gaming experience for players. As is well known, Bingo cards are utilized which have random arrangements of spaces thereon In the case of classical Bingo, these spaces have numbers distributed thereon in multiple patterns. In play, corresponding numbers are randomly drawn and announced to the players. If a number is called which-appears on the player's card, the corresponding space or section of the Bingo card is blackened or covered. In the process of play, a bingo is achieved when these spaces are blackened or covered to form a single straight line or a predetermined pattern on the card.

The game of Bingo also provides a more varying and diverse set of prize award opportunities. For example, it is not uncommon for a particular Bingo-round to be played for a predetermined prize. For example, a set monetary amount may be used as the prize, or other non-monetary items. Other examples include gift certificates, etc. Consequently, the actual gaming experience can be tailored by providing different winning opportunities.

It is highly desirable to develop wagering games to provide maximum excitement and involvement for the players. In doing so, this provides the most exciting and enjoyable playing experience. One way to produce a more exciting playing experience is to provide additional wagering or winning opportunities for the participants. Care must be taken, however, to insure that these wagering or winning opportunities are not too complex so as to frustrate the players. If these games and wagering opportunities do become too complex, players will be turned off from these games and avoid further participation.

SUMMARY OF THE INVENTION

The method of the present invention provides a new wagering game which includes an additional winning opportunity for players who are playing a game of chance such as Blackjack. In the process of playing the game of the present invention, the Blackjack player is provided with additional gaming cards to participate in this additional game. These additional gaming cards are specifically tailored for participation in the wagering game of the present invention. However, these gaming cards somewhat resemble a classical bingo card in their layout. Rather than having numbers in the various "boxes" of the gaming card, however, specific Blackjack hands are listed. More specifically, listed hands or combinations of cards are those that are typically attained while playing Blackjack (i.e. Blackjack hands).

In order to participate, a player must first obtain a gaming card. Depending on the specific desires of the gaming institution, these gaming cards may either be sold or given away as part of a promotion. As previously mentioned, these gaming cards resemble Bingo cards, but have Blackjack hands, or card combinations typically encountered while playing Blackjack listed thereon.

Next, the player proceeds by playing standard Blackjack in the well known manner. However, the player must be sure to locate and participate at a gaming table which is set up to play this additional game. Typically, the dealer at the particular gaming table will have gaming cards available right at the table.

As is well known, the play of Blackjack consists of initially dealing two cards to the player and two cards to the dealer. The player's cards are typically dealt face up while at least one of the dealer's cards is typically dealt faced down. Play proceeds by allowing the player to take additional cards to enhance their hand, or to stand with their existing hand, etc. After the player has finished playing their hand, the dealer proceeds to play his hand. At the end of each round, the player's hand is compared with the dealer's hand and the player then wins or loses based upon this comparison.

The present-invention provides an added dimension to this game by allowing the player to watch their gaming card as they are playing their Blackjack hand. Should a predetermined configuration of cards be dealt to the player, or a predetermined hand be obtained, the player then also has a "play" on the gaming card. Specifically, if the predetermined hand which the player has received is also listed on the gaming card, the player then is given the opportunity to blacken or mark the spot listings that hand. As can be appreciated, during extended periods of play, the player is given several possibilities to darken many spots on the gaming card.

When playing the game of the present invention, the player is given multiple gaming experiences. More specifically, the player is given the opportunity to participate in standard Blackjack, including all of the excitement associated therewith. Additionally, the player is given the excitement and enjoyment of participating in this additional winning opportunity by monitoring and tracking their progress on the gaming card. When certain patterns are achieved on the gaming card (e.g., straight lines of marks or black outs, a diamond shaped configuration, marks in all four corners, an x-shape, etc.), the player qualifies to win certain prizes. These prizes could be monetary amounts or other predetermined prizes.

It is an object of the present invention to provide a new and exciting winning opportunity for players participating in a standard wagering game. This exciting and new winning opportunity will allow for immediate winnings during the process of the game. It is a further object that these additional payouts will create anticipation and excitement while the cards are being dealt. This anticipation and excitement will exist as the players are looking forward to receiving their next card.

Another object of the present invention is to provide an additional winning opportunity which generally does not interfere with the playing the base game. The designated combinations of cards which are chosen to be on the gaming card are those traditionally encountered during the play of Blackjack.

It is a further aspect of the present invention to provide an additional winning opportunity which will award the players winnings based on the receipt of predetermined cards by that player.

BRIEF DESCRIPTION OF THE DRAWINGS

Further objects and advantages of the present invention may be seen by reading the following detailed description in conjunction with the drawings in which:

FIG. 2 is an illustration of one example of a gaming card used in conjunction with the present invention.

DETAILED DESCRIPTION OF PREFERRED EMBODIMENTS

The present invention provides a method of playing a wagering game which combines the thrill and excitement of multiple wagering games into one. More specifically, the present invention combines a well known game of chance, such as Blackjack or Poker, and Bingo to provide an overall game with new and different winning opportunities creating a different gaming experience for the player.

Figure 1:
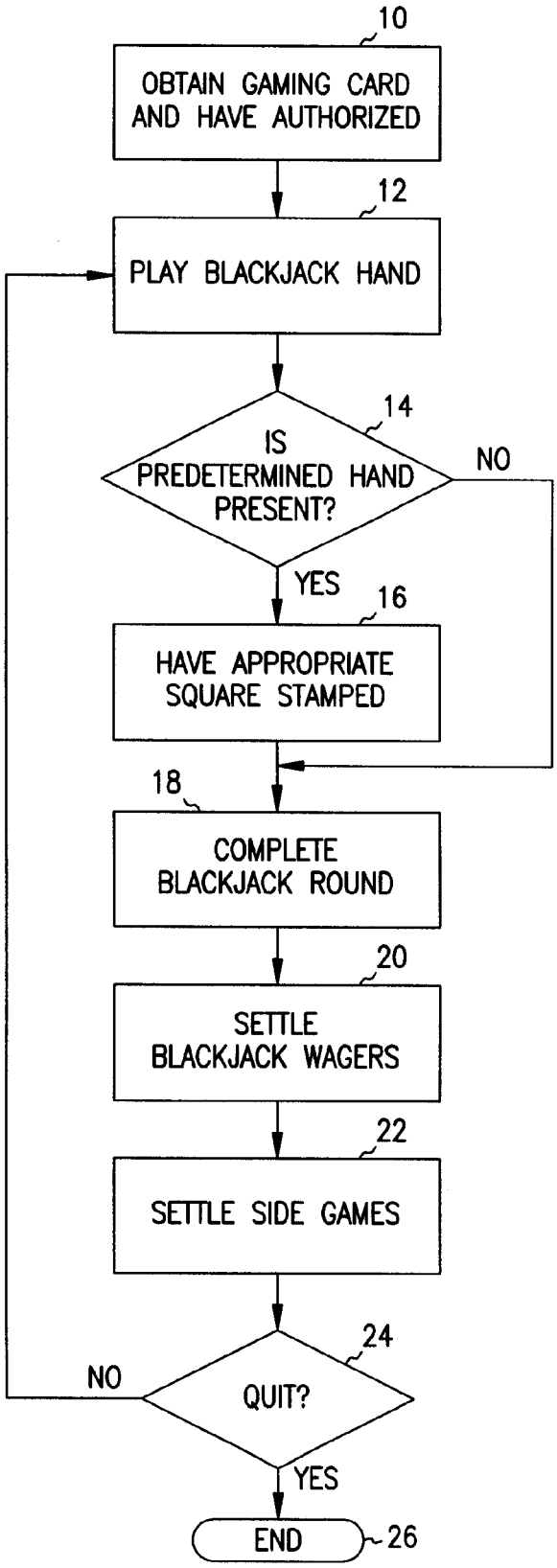
FIG. 1 is a flow chart outlining the method of the present invention.

Referring to FIG. 1, there is shown a flow chart illustrating the method of the present invention. Initially, the method starts at step 10 wherein the player obtains a gaming card and also has this card authorized. One example of a gaming card used in conjunction with the present invention is shown in FIG. 2 and will be described in further detail below.

Typically, authorization of the gaming card is done by a dealer at the gaming table. Thus, this step of obtaining and authorizing the gaming card typically involves proceeding to a Blackjack gaming table and taking all steps to begin playing Blackjack. Next, the method of the present invention proceeds by starting to play a Blackjack hand as shown in step 12. As is well known, this typically involves the dealing of two cards to both the player and the dealer. Subsequently, play is continued by allowing the player the opportunity to take another card, or to stand with the existing hand that is dealt. The player is continually given this opportunity until they have reached a point where they have either exceeded a hand total of twenty-one, or they have decided to stand on the hand dealt. When the player's hand has exceeded a card value of twenty-one, it is typically said that the player has busted and have lost their wager.

While going through this process, the player typically will also have their gaming card available so that they can monitor their progress towards winnings thereon in addition to their progress in the Blackjack game. This allows the player to watch both the gaming card and their progress in the Blackjack game.

After completion of the Blackjack hand, the player examines their existing hand to determine if they have obtained one of the predetermined arrangements of cards listed on their gaming card. This is shown in step 14 of the flow chart shown in FIG. 1. If a predetermined arrangement of cards has been received, the player notifies the Blackjack dealer and the appropriate square on their gaming card is blackened, as shown in step 16. Following this step, the Blackjack round is completed, as shown in step 18. Completion of this step is also undertaken in instances where the predetermined arrangements of cards are not obtained. This step of completing the Blackjack round typically includes progress around the gaming table, thus allowing other players to complete their hands. Finally, the dealer is allowed to complete their hand, thus completing the Blackjack round. As is well known, Blackjack wagers are then settled based upon the arrangements of cards held by both the player and the dealer. Generally speaking, if the player has a hand with a card total higher than that of the dealer, but yet under a card total of twenty-one, the player wins on their wager and is paid out at a predetermined amount. This predetermined amount is often a one-for-one payoff of the amount wagered.

Next, the progress of the additional game is analyzed or settled. More specifically, the player is given the opportunity to analyze their gaming card to determine if they have qualified for additional winnings. For example, if the player has now blackened five squares in a line, the player is now eligible for a prize or winnings as set forth on the gaming card game.

As always, the player is given the opportunity to continue playing as many rounds of Blackjack as they desire. Thus, in step 24 the players are asked if they want to quit or continue. If they quit, the process moves to step 26 where the gaming method is ended. Alternatively, if the player wishes to continue playing, in step 24 the process moves back to step 12 where a new Blackjack hand is played. This same overall process can continue indefinitely, allowing the player to continue to play as many Blackjack hands as they desire.

As discussed above in conjunction with step 14, wherein the player determines if a predetermined hand is present, it is understood that multiple variations of this predetermined hand could be used. Generally speaking, certain combinations of cards which are generally obtained can be placed on the gaming card in the specific squares thereof.

Referring specifically to FIG. 2, there is shown one example gaming card 50 which has a number of various possible combinations listed in each of the squares 52. For example, square 54 shows the combination of a six, a seven, and an eight in the player's hand. Square 56 shows a "Five Card Charlie" which is a common name for any combination of five cards totaling less than twenty-one. Square 58 has listed thereon an "Ace-Jack of Hearts Blackjack." Specifically, this hand includes an ace of hearts and a jack of hearts which total twenty-one and is commonly referred to as a Blackjack hand.; Similarly, square 60 includes a "Ace-Jack of Clubs Blackjack," square 62 includes an "Ace-Jack of Spades Blackjack," and square 64 includes a "Ace-Jack of Diamonds Blackjack." On a similar note, square 66 lists a "Same Suit blackjack." This hand consists of any combination of an ace and any same suit card having a value of ten (e.g. Ace-King of Clubs, Ace-Ten of Hearts, . . . ).

During play of Blackjack, it is very common to "split" hands, thus creating multiple hands. This is a player's choice when a pair is received upon initial dealing. This type of hand is also listed on gaming card 50 in square 68. Another winning hand which could be obtained is one containing three 7's, which is listed in square 70. Lastly, gaming card 50 includes a "Split to Make Three Hands" listing shown in square 72. As mentioned above, the ability to split hands is fairly well known by those skilled in the art. As also well known, it is very easy to further split, thus resulting in three hands. This is the phenomena that is anticipated by the listing in square 72.

It is understood that the various hands shown in FIG. 2 are merely examples of those which could be chosen for placement on gaming card 50. These particular hands do provide thrill and excitement in that they are fairly unique hands, but also provide winning opportunities for the players.

Upon receipt of these various hands, it can be seen how a player will proceed towards completion of the Bingo game. Various combinations of squares on the gaming card can be utilized as winning configurations for the player. Many of these are well known configurations of Bingo including blackening of multiple squares in a line, blackening two lines to make an X on the card, blackening four corner squares, blackening squares to create a diamond shape on the card, etc. Based upon these various card configurations, multiple prizes can be awarded to the players. Again, depending upon the desires of the gaming institution, these prizes may include monetary prizes or other non-monetary awards. For example, various prizes could include free meal gift certificates.

As is well understood in the gaming industry, most casino games can now be implemented in a computer system or a similar video gaming device. These systems typically include a display in conjunction with a processing device. The processing device is preprogrammed to carry out the steps of the wagering game, thus allowing the players to participate in these video gaming systems.

Figure 3:
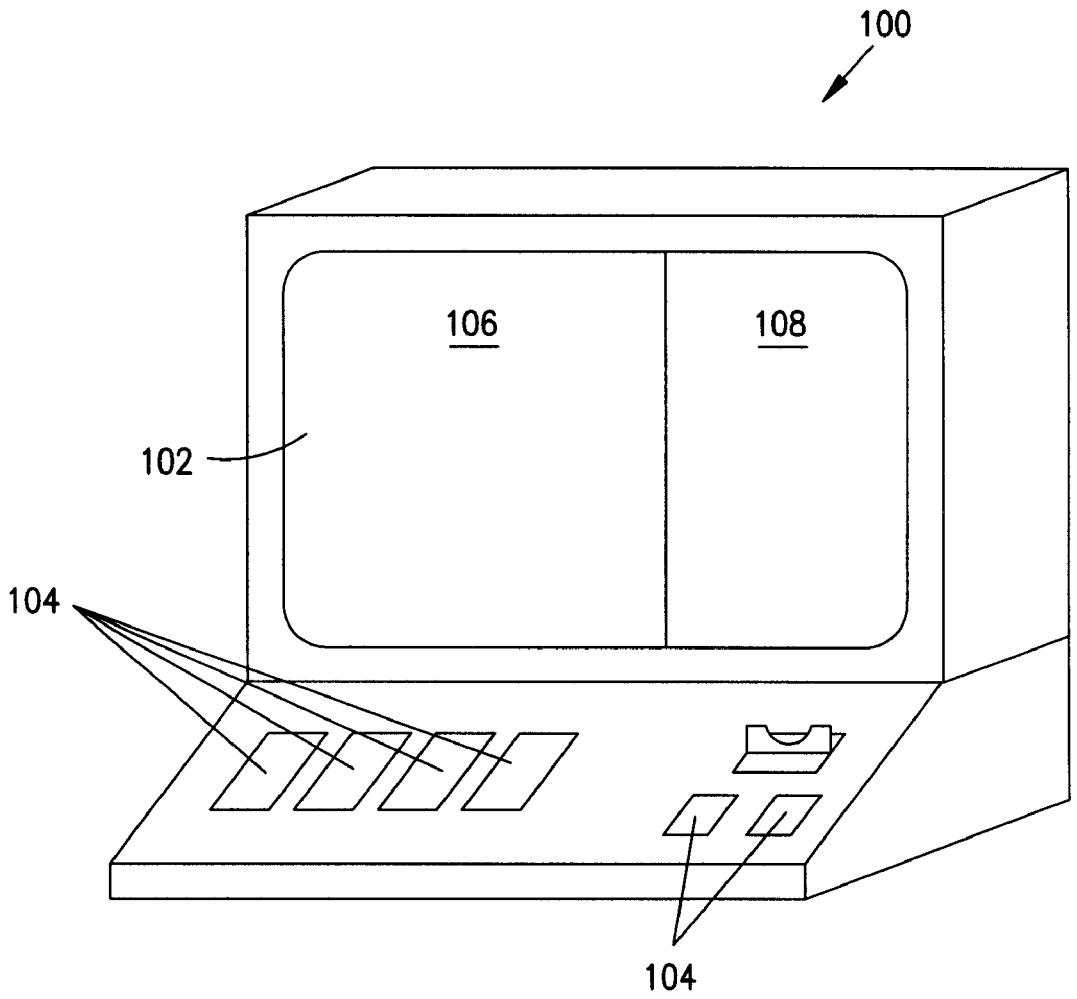
FIG. 3 is a schematic illustration showing a video gaming device which implements the wagering method of the present invention.

Referring now to FIG. 3, there is shown one embodiment of a video gaming implementation of the present invention. As can be seen, this video gaming apparatus 100 includes a display 102 and a plurality of input buttons 104. By appropriately operating the input buttons in response to the display screens, a player can carry out the process of the wagering game described above. That is, the display can easily be provided with a Blackjack display section 106 and a gaming card display section 108. In the Blackjack display section, the process of playing the Blackjack hand is carried out in a well known manner. More specifically, cards are dealt to the player, and they are given the opportunity to hold or discard these hands. Similarly, the player's gaming card is maintained in gaming card window 108. In this gaming system, the processor is preprogrammed to recognize when these predetermined hands have been obtained and to automatically blacken appropriate squares on the gaming card. Consequently, the method of playing this enhanced wagering game is fully carried out by this gaming system.

While the above discussion deals with an implementation of the present method utilizing a gaming card used along with the game of Blackjack, it is equally understood that this same concept could be used for other base games. For example, many variations of Poker could be played in conjunction with a similar gaming card. In this version,.the gaming card would simply list common hands typically obtained when playing Poker, as opposed to those obtained when playing Blackjack. Again, this version of the game utilizing either Blackjack or poker could also be implemented in a video gaming apparatus.

Other variations on this combined game are possible. For example, the game could be modified to be played in a bingo hall. That is, a single hand of blackjack could be played while multiple people watched with gaming cards in hand. Other variations are possible which combine additional winning opportunities with a game of chance.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A method of providing an additional winning opportunity for a plurality of players playing a game of chance which utilizes standard playing cards, comprising:

each of the plurality of players obtaining a gaming card each gaming card, including a plurality of squares thereon, each of the squares listing one of a plurality of predetermined arrangements of standard playing cards;

each of the plurality of players making a wager to participate in the game of chance;

a single dealer dealing cards to each of the plurality of players as directed by the rules of the game of chance;

at least one of the plurality of players completing their hand in the game of chance and checking the arrangement of cards in the at least one player's hand, if the arrangement of cards matches one of the predetermined arrangements of cards listed on the gaming card the at least one player blackening the square listing that predetermined arrangement of cards; and the dealer completing the play of the casino game.

2. The method of claim 1 further comprising:

at least one of the plurality of players repeating play of the casino game multiple times; and at least one of the plurality of players determining if a predetermined pattern of squares have been blackened, and if the predetermined pattern of squares has been blackened, at least one player receiving a predetermined winnings.

3. A method of playing a card game comprising:

playing a card game, the card game including a single dealer and a first set of players, wherein the dealer provides a plurality of cards to each of the first set of players, the cards received by each of the first set of players dependent on the cards dealt by the single dealer;

playing a board game which includes a plurality of boards, the board game played by a second set of players, each board including a plurality of squares thereon, each of the squares listing one of a plurality of predetermined arrangements of playing cards obtainable in the card game wherein a square of a board is marked when a predetermined arrangement of playing cards is obtained during the card game.

4. The method of claim 3 wherein the second set of players is a subset of the first set of players.

5. The method of claim 4 further comprising the second set of players paying a fee to play the board game.

6. The method of claim 3 wherein the second set of players is not a subset of the first set of players.

7. The method of claim 6 further comprising the second set of players paying a fee to play the board game.

8. The method of claim 3 wherein at least two of the boards associated with the board game have different listings of the predetermined arrangements in corresponding squares of the board.

9. The method of claim 3 further comprising the second set of players receiving winnings based on a pattern of marked squares.

10. The method of claim 9 wherein the winnings are predetermined.

11. The method of claim 9 wherein the winnings are predetermined, the predetermined winnings listed on the board of the board game.

12. The method of claim 3 further comprising the first set of players each placing a wager to participate in the card game.

13. The method of claim 3 wherein the card game includes playing a plurality of hands.

14. The method of claim 3 wherein the card game includes playing a plurality of rounds.

15. The method of claim 3 wherein the card game is played manually.

16. The method of claim 3 wherein the board game is played manually.

17. A method of playing a board game comprising:

a first player playing a card game in which various predetermined arrangements of cards may be obtained; and a second set of players playing a board game including a board including a plurality of squares thereon, each of the squares listing one of a plurality of predetermined arrangements of playing cards obtainable in the card game wherein a square of a board is marked when a predetermined arrangement of playing cards is obtained during the card game.

18. The method of claim 17 wherein the second set of players does not include the first player.

19. The method of claim 18 wherein the second set of players is a single player.

20. The method of claim 18 wherein the second set of players is a plurality of players.

* * * * *